US007155850B2

(12) United States Patent
Wilinsky, Jr. et al.

(10) Patent No.: US 7,155,850 B2
(45) Date of Patent: Jan. 2, 2007

(54) SAFETY TRAFFIC CONTROLLER STATION

(76) Inventors: John Wilinsky, Jr., 115 W. 35th St., Reiffton, PA (US) 19606; Beverly A. Weihe-Wilinsky, 115 W. 35th St., Reiffton, PA (US) 19606

( * ) Notice: Subject to any disclaimer, the term of this patent is extended or adjusted under 35 U.S.C. 154(b) by 336 days.

(21) Appl. No.: 10/882,584

(22) Filed: Jul. 1, 2004

(65) Prior Publication Data

US 2006/0000131 A1 Jan. 5, 2006

(51) Int. Cl.
*G09F 15/00* (2006.01)

(52) U.S. Cl. ..... 40/606.08; 40/612; 116/63 P

(58) Field of Classification Search ..... 40/606.08, 40/612, 606.03; 116/63 P
See application file for complete search history.

(56) References Cited

U.S. PATENT DOCUMENTS

| | | | | |
|---|---|---|---|---|
| 2,564,145 | A | 8/1951 | Beall et al. | |
| 3,675,613 | A | 7/1972 | Sayles | |
| 3,886,519 | A | 5/1975 | Hovland | |
| 4,777,751 | A | 10/1988 | Pasquale | |
| 5,422,638 | A | 6/1995 | Singer et al. | |
| 6,052,067 | A | 4/2000 | Nuxoll | |
| 6,104,313 | A * | 8/2000 | Boyd, II | 340/908.1 |
| 6,169,477 | B1 * | 1/2001 | Fiato | 340/326 |
| 6,374,524 | B1 * | 4/2002 | Capps | 40/612 |
| 2002/0104242 | A1 * | 8/2002 | Haugen | 40/606 |

* cited by examiner

*Primary Examiner*—Gary C. Hoge
(74) *Attorney, Agent, or Firm*—Kenyon & Kenyon LLP

(57) ABSTRACT

A portable safety traffic controller station is provided having a base unit having a rear base support, a front base support, and at least one transverse brace joining the rear base support and the front base support; a seat secured to a seat mounting frame, the seat mounting frame secured to the base unit; a rotationally movable sign pole supported by the base unit; a shading pole releasably mounted to the base unit; and means for shading releasably secured to the shading pole.

12 Claims, 3 Drawing Sheets

SAFETY TRAFFIC CONTROLLER STATION

FIELD OF THE INVENTION

The present invention relates generally to the field of traffic control devices, and more particularly to portable, collapsible traffic control stations.

BACKGROUND OF THE INVENTION

A traffic safety operator or "flagperson" is routinely dispatched at roadway construction sites or other situations demanding management of traffic flow in a restricted area. The flagperson, while standing, most often operates a pole, typically having a sign mounted thereon, bearing STOP and SLOW directives. The flagperson may also be expected to manually direct traffic with hand flags, and verbally provide additional information to motorists. The flagperson is typically adorned with a bright colored, reflective safety vest as the only means for ensuring visibility to oncoming motorists.

The flagperson's job demands that he or she be alert, since mistakes can lead to injury to motorists or highway construction workers otherwise concentrating on their tasks. However, the flagperson must continually fight fatigue and discomfort resulting from long hours of standing, in possibly hot temperatures typically generated by slow moving traffic and mid-day sunlight bearing down on highway pavement, as well as the distraction of inclement weather. The rigors of traffic signaling may unnecessarily preclude physically challenged individuals from participating in this line of work.

Remote controlled traffic devices have been proposed to replace a human flagperson, but have not gained wide acceptance. See, for example, U.S. Pat. Nos. 6,052,067 and 5,422,638. Such devices take away the experience and instant decision-making capabilities of a human flagperson necessary to manage ever-changing traffic situations. Further, motorists often request information from flagpersons, or the flagperson is required to communicate additionally important information that the sign alone cannot, such as alternate traffic routes.

There is therefore a need for a traffic control device that keeps the human at the site, in direct communication with the traffic management situation and with motorists; that provides comfort to a flagperson enabling long hours of alert flagging while minimizing fatigue; that enables physically challenged individuals or those with disabilities to work as flagpersons; provides additional safety by offering increased visibility to the worker that would otherwise be too bulky and impractical to wear; and that is collapsible and portable for ease of transport from one worksite to another.

SUMMARY OF THE INVENTION

The present invention provides a traffic control safety device exhibiting these required characteristics. A portable safety traffic controller station of the invention comprises a base unit having a rear base support, a front base support, and at least one transverse brace joining the rear base support and the front base support; a seat secured to a seat mounting frame, the seat mounting frame secured to the base unit; a rotationally movable sign pole supported by the base unit; a shading pole releasably mounted to the base unit; and means for shading releasably secured to the shading pole.

DETAILED DESCRIPTION

Figure 1:
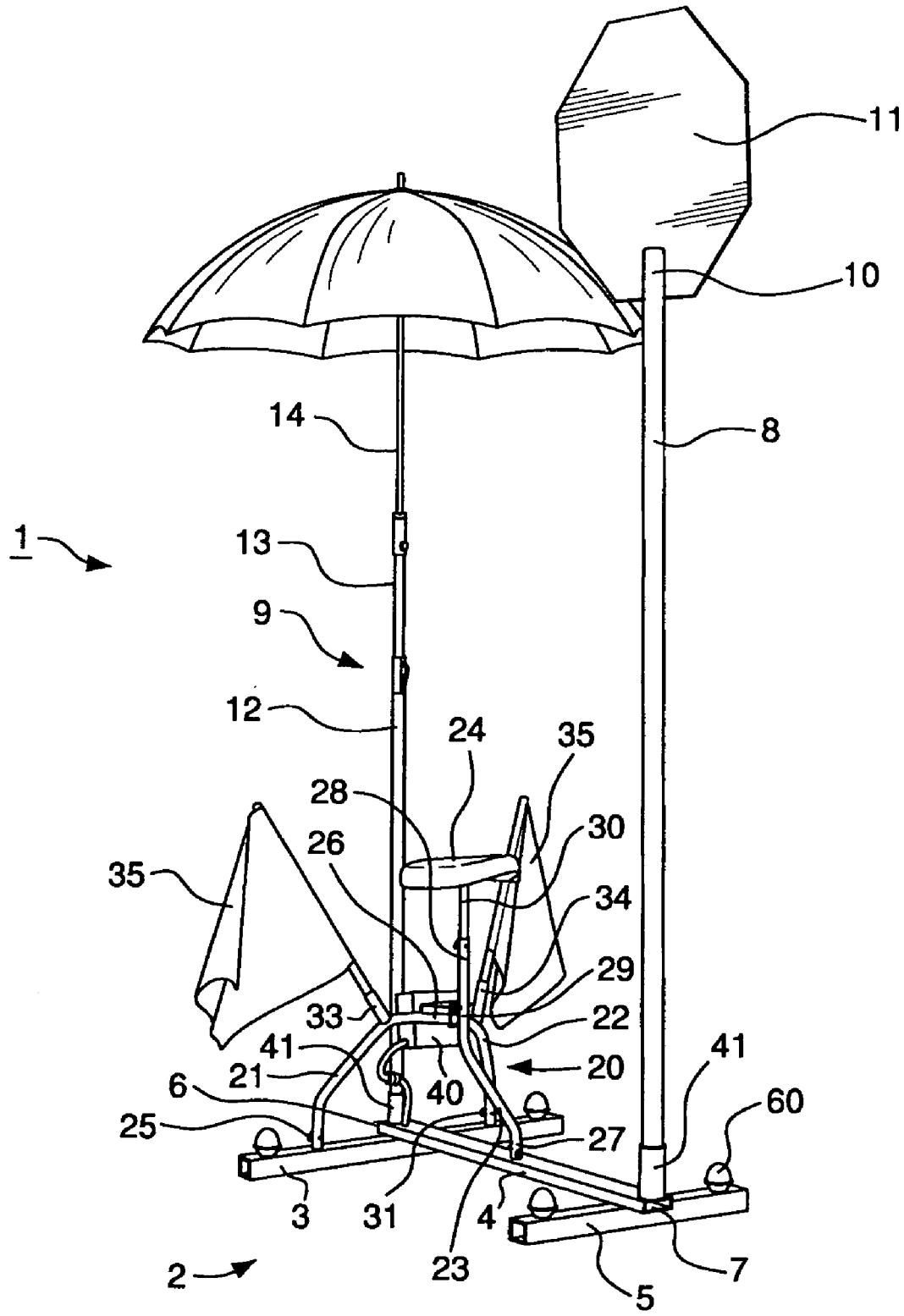
FIG. 1 is an isometric view of a preferred embodiment of the safety traffic controller station of the invention.
Figure 2:
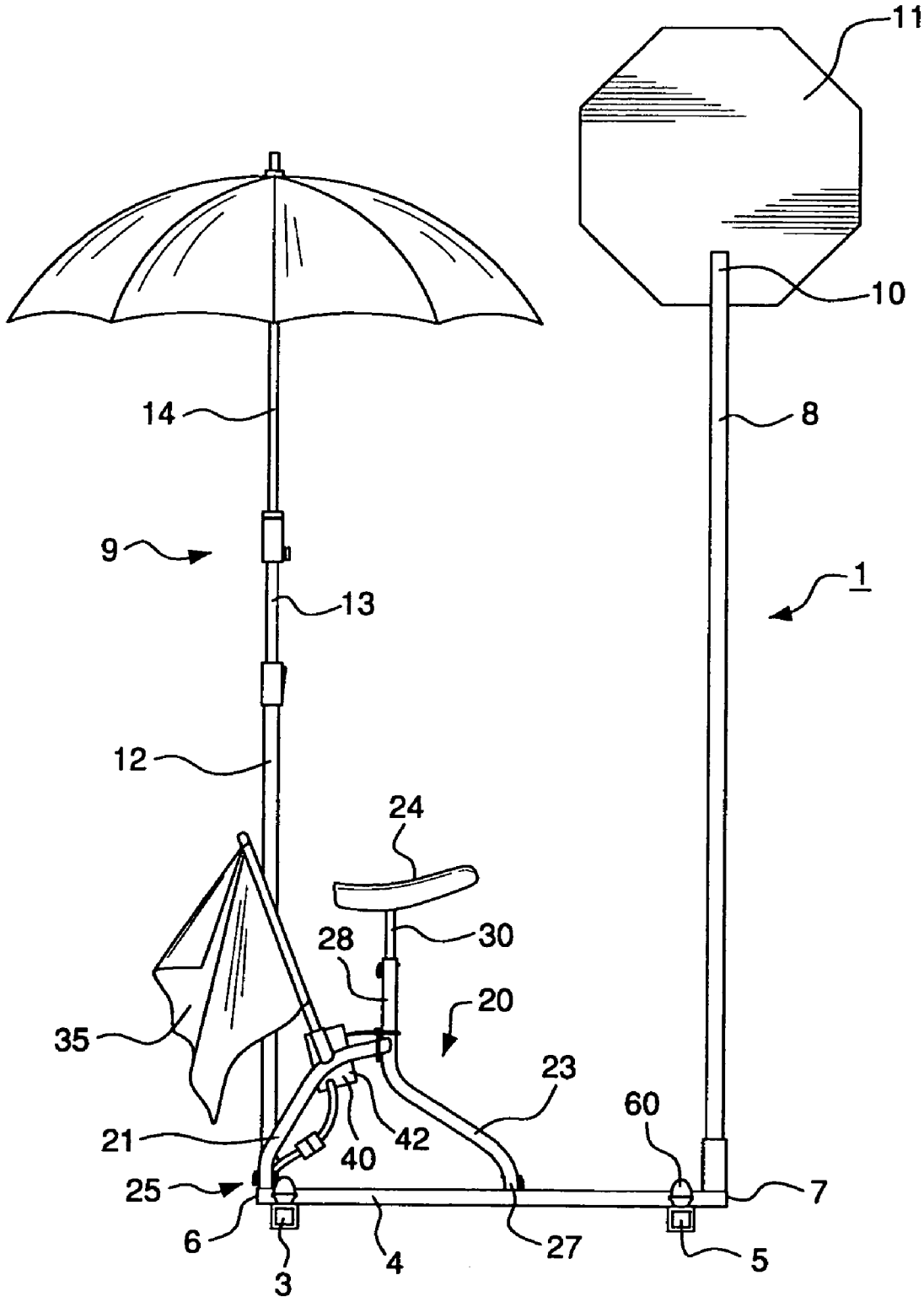
FIG. 2 is a front elevational view of a preferred embodiment of the safety traffic controller station of the invention.

A preferred embodiment of the present invention will now be explained with reference to the drawings. As shown in FIGS. 1 and 2, a safety traffic controller station 1 has a base unit 2 having a rear base support 3 and front base support 5 joined to a transverse brace 4. The base unit 2 is preferably made from a lightweight, but mechanically strong material appropriate for ease of portability and the physical environment expected at construction sites. A preferred material is square hollow aluminum stock, such as a 2"×2" sizing.

In a preferred embodiment, transverse brace 4 is bolted to the rear base support 3 and front base-support 5 for ease of disassembly. The transverse brace is preferably made from hollow aluminum stock, and, for example, may have a 3"×1" sizing. The transverse brace 4 may be preferably bolted to rear and front base supports 3, 5 by use of, for example, hollow bolts utilizing nylon flat washers and upper and lower locking nuts (all not shown). Alternatively, additional transverse brace supports may join the rear and front base supports. Wheels may optionally be secured to the base unit 2. As further shown in the Figures, safety lighting elements 60, such as strobe lights approved for highway traffic control deployment, are affixed to the base unit 2. Wiring for the lights may run internally through the hollow base unit members, 3, 4 and 5. Rubber end caps, for example, may be affixed to open ends of the rear and front base supports, as well as the transverse brace.

The transverse brace 4 has a first end 6 and a second end 7. At positions on the transverse brace 4 adjacent first end 6 and second end 7, cylindrical hollow mounts 41 of aluminum (or other appropriate material) are secured to the transverse brace (preferably by welding), extend upwardly, and are adapted to receive a sign pole 8 and a shading pole 9. The sign pole 8 and shading pole 9 are preferably cylindrical and of a diameter slightly smaller than the mounts 41 affixed to the transverse brace 4, so as to enable the sign pole 8 and shading pole 9 to be received within the mounts and remain rotatably mounted to the base unit 2. The shading pole 9, in particular, may be further secured, if desired, to the mount 41 by a locking pin through the shading pole 9 and the mount to prevent movement.

Alternatively, the sign pole 8 or the shading pole 9 may, instead of being received in a mount 41, be placed over a stud affixed to the base unit 2, the stud having a diameter smaller than the internal diameter of the sign pole or shading pole that permits the poles placed thereon to be rotatable about the stud.

The sign pole 8 is preferably made of a lightweight hollow material, such as PVC tubing, and is preferably a unitary structure, but may be secured in sections if desired. A sign 11 is affixed to the sign pole 8 at a top end 10. The sign 11 is preferably releasably mounted to the sign pole 8 by, for example, bolts and wing nuts to promote easy disassembly and sign changes. Sign 11 is preferably reversible, and may communicate the conventional traffic management directives "STOP" on a first side, and "SLOW" on the opposing side. Other signs may be employed communicating different messages appropriate for the specific traffic situation.

The sign pole 8 is preferably completely rotatable within the mount 41 upon which it is received so that traffic warnings communicated by the sign can be quickly changed by the operator. The sign pole 8 may further be adorned with additional conspicuity safety indicia, such as iridescent paint, reflective striping, or lighting. Alternatively, the sign pole 8 could be identically rotatably mounted to the front base support 5.

As noted, the shading pole 9 is supported within an upwardly extending mount 41 positioned on the base unit 2, preferably at a position on the transverse brace 4 opposite the positioning of the sign pole 8 (shown in FIGS. 1 and 2 at a position adjacent to a first end 6). As noted, the mount is preferably made of hollow aluminum welded to the base unit 2. The shading pole 9 is preferably made from hollow PVC or similar material. The shading pole 9 may be a unitary structure, but preferably comprises a primary shading base pole 12 actually positioned within the mount, and a height adjustment pole 13 secured to the primary shading base pole 12, preferably by a locking pin mechanism exemplified by a cotter hitch pin or metal locking spring (not shown). The height adjustment pole 13 may telescopically engage the primary shading base pole 12, and have a plurality of holes drilled therein to accommodate different extensions of the height adjustment pole 13 rising from the primary shading base pole 12.

At an end of the height adjustment pole 13 opposite the end secured to the primary shading base pole 12, a conventional umbrella 14 may be releasably secured to the height adjustment pole 13. An opened umbrella 14 may be employed to provide shade to the operator, as well as relief from precipitation. The umbrella 14 and/or shading pole 9 may further be adorned with additional conspicuity safety indicia, such as iridescent paint, reflective stripings, or lights.

The umbrella pole 9 may instead be releasably secured to the rear base support 3 if desired. The umbrella 14 may be replaced with alternative shading means, such as a canopy or awning.

Additionally, a clear vinyl enclosure (not shown) may be positioned or draped over the safety traffic controller station in lieu of an umbrella for additional protection from inclement weather. Such an embodiment may additionally be outfitted with a heating or cooling means, such as an electric heater or a fan.

A seat mounting frame 20 preferably comprises two rear seat legs 21, 22 and a front seat leg 23, all releasably secured to the base unit 2, and supporting a seat 24. The seat mounting frame is preferably made of hollow steel tubing, but is not limited to that material. In a preferred embodiment shown in FIGS. 1 and 2, rear seat leg 21 has a first end 25 and a second end 26. The first end 25 of the rear seat leg 21 is received over an upwardly protruding stud of solid aluminum (not shown) on the rear base support 3, and is releasably secured thereto by, for example, a locking pin. A front seat leg 23 has a first end 27 and a second end 28. The first end 27 of the front seat leg 23 is received over an upwardly protruding stud of solid aluminum (not shown) on the transverse brace 4, and is releasably secured thereto by a locking pin, for example. A seat 24 is adjustably secured to the front seat leg 23 at the second end 28 of the front seat leg 23.

The seat 24 is preferably secured to a seat height adjusting pole 30, preferably made from hollow aluminum tubing, which is telescopically received, and slidable within, the hollow front seat leg 23 at its second end 28. By virtue of holes drilled through the seat height adjusting pole 30, the preferred height of the seat 24 may be determined and the seat 24 releasably secured to the seat height adjusting pole 30 via a steel spring locking pin, for example.

A rear seat leg 22 has a first end 31 and a second end 32. In a manner similar for that of rear leg 21, rear leg 22 is releasably secured by a locking pin to rear base support 3 by being received over an outwardly protruding stud (not shown) on the rear base support 3 at the first end 31 of the rear seat leg 22.

The front seat leg 23 is adapted to receive the second end 26 of the rear seat leg 21 and the second end 32 of the rear seat leg 22 at a position 29 on the front seat leg 23, wherein two hollow standards (not shown) preferably made of hollow steel tubing are welded to the front seat leg 23 at an angle sufficient to accommodate the rear seat legs 21, 22. The second ends 26 and 32 of the rear seat legs 21 and 22, respectively, are slidably placed over the standards and the rear seat legs 21, 22 are releasably secured to the front seat leg 23 by, for example, a locking pin exemplified by a cotter hitch pin. In this manner, the seat mounting frame 20 is completely collapsible for ease of disassembly and portability.

In a preferred embodiment, blind posts 33 and 34 are respectively affixed to rear seat legs 21 and 22. Blind posts 33 and 34 are adapted to receive hand flags 35, which are slidably inserted into blind posts 33, 34. In this manner, hand flags 35 may be quickly accessed by the operator to, for example, direct traffic. Hand flags 35 can be easily stored in the blind posts 33, 34 when not in use.

A power means 40, such as a battery pack, is preferably mounted to the seat mounting frame 20. A typical battery may be a 12 V, 5 Ah rechargeable sealed lead acid battery. The power means 40 are preferably housed within a battery case 42 made from, for example, plastic having a steel frame. The battery case 42 may additionally house a toggle switch for lighting elements affixed to the safety traffic controller station and wiring plug-in components for the system. The battery may be connected to a male 4-way plug, for example, that in turn connects to a female 4-way plug having cords running through the hollow aluminum stock of the of the base support to the lighting elements 60. The male-female connection is preferably outside of the battery case 42.

Figure 3:
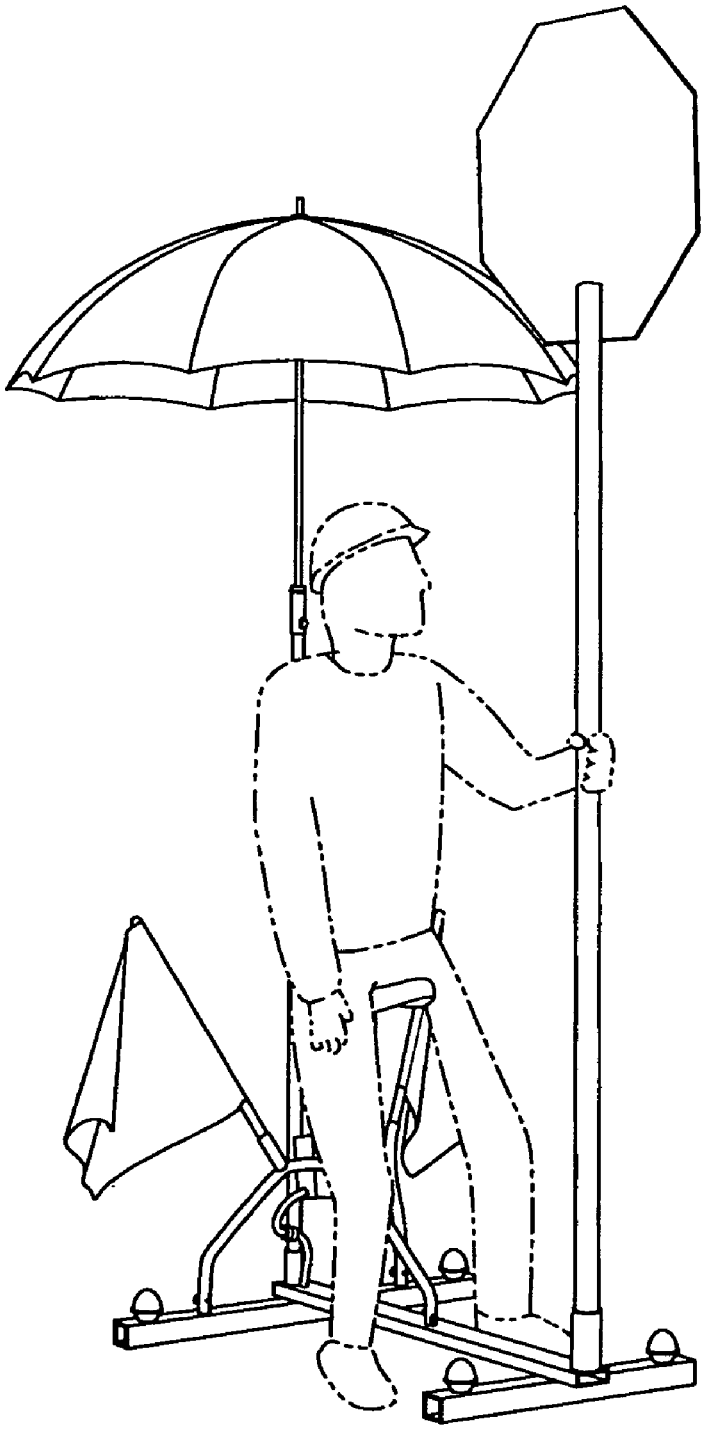
FIG. 3 is an isometric view of the safety traffic controller station of FIG. 2, particularly showing a flagperson, shown in phantom, utilizing the safety traffic controller station.

FIG. 3 depicts how a flagperson may utilize a safety traffic controller station of the invention. As shown in phantom, a flagperson may support his weight by leaning on the seat while managing the rotatable sign pole, and having simultaneous access to the hand flags.

While there is shown and described the present preferred embodiment of the invention, it is to be understood that this invention is not limited thereto, but may be variously embodied to practice within the scope of the following claims. It will be appreciated by those skilled in the art that various modifications and alternatives to those details could be developed in light of the overall teachings of the disclosure.

What is claimed is:

1. A portable safety traffic controller station comprising:

a base unit comprising a rear base support, a front base support, and at least one transverse brace joining the rear base support and the front base support;

a seat secured to a seat mounting frame, the seat mounting frame secured to the base unit;

a rotationally movable sign pole supported by the base unit;

a shading pole releasably mounted to the base unit; and means for shading releasably secured to the shading pole.

2. The safety traffic controller station of claim 1, further comprising power means for providing electricity.

3. The safety traffic controller station of claim 1, further comprising at least one lighting element mounted on the base unit.

4. The safety traffic controller station of claim 1, further comprising safety indicator means on the sign pole.

5. The safety traffic controller station of claim 4 wherein the safety indicator means comprise reflectors.

6. The safety traffic controller station of claim 1, further comprising at least one blind post adapted to support a removable hand flag, the at least one blind post positioned on the seat mounting frame, the base unit, or the umbrella pole.

7. The safety traffic controller station of claim 1, wherein the means for shading comprise an umbrella.

8. The safety traffic controller station of claim 1, wherein the height of the seat is adjustable.

9. The safety traffic controller station of claim 1, wherein the height of the shading means is adjustable.

10. The safety traffic controller station of claim 1, wherein the seat is releasably secured to the seat mounting frame, the seat mounting frame comprising at least one seat leg releasably secured to the base unit.

11. The safety traffic controller station of claim 10, wherein a power means is mounted to the seat mounting frame and at least one blind post adapted to support a hand flag is positioned to the seat mounting frame.

12. A safety traffic controller station comprising:

a base unit comprising a rear base support, a front base support, and at least one transverse brace joining the rear base support and the front base support;

a seating unit comprising at least two rear seat legs, independently releasably secured to the rear base support, and releasably secured to a front seat leg releasably secured to the transverse brace, and a seat releasably secured to the front seat leg;

a rotationally movable sign pole supported by the base unit, the sign pole having a sign secured thereto;

a shading pole releasably mounted to the base unit on a side of the base unit opposing the sign pole, and an umbrella releasably secured to the shading pole.

* * * * *